US006016608A

United States Patent [19]

Lorocco

[11] Patent Number: 6,016,608

[45] **Date of Patent: *Jan. 25, 2000**

[54] SIGHTING DEVICES FOR PROJECTILE TYPE WEAPONS

[76] Inventor: Paul M. Lorocco, 4110 Shady Hill Dr., Dallas, Tex. 75229

[ * ] Notice: This patent is subject to a terminal disclaimer.

[21] Appl. No.: 09/185,275

[22] Filed: Nov. 3, 1998

Related U.S. Application Data

[62] Division of application No. 08/834,763, Apr. 3, 1997, abandoned, which is a division of application No. 08/506,722, Jul. 26, 1995, Pat. No. 5,638,604, which is a continuation of application No. 08/173,503, Dec. 23, 1993, Pat. No. 5,442, 861.

[51] Int. Cl.[7] ..... F41G 1/467

[52] U.S. Cl. ..... 33/265

[58] Field of Search ..... 33/233, 241, 242, 33/243, 261, 265

[56] References Cited

U.S. PATENT DOCUMENTS

| | | | |
|---|---|---|---|
| 837,563 | 12/1906 | Hartman . | |
| 2,610,405 | 9/1952 | Dickinson | 33/47 |
| 2,706,335 | 4/1955 | Munsey | 33/241 |
| 3,098,303 | 7/1963 | Plisk | 33/241 |
| 3,578,973 | 5/1971 | Dooley et al. | 250/71 |
| 3,949,482 | 4/1976 | Ross | 33/241 |
| 4,030,203 | 6/1977 | Ackerman, Jr. | 33/241 |
| 4,070,763 | 1/1978 | Carts, Jr. | 33/241 |
| 4,166,324 | 9/1979 | Carollo et al. | 33/265 |
| 4,177,572 | 12/1979 | Hindes | 33/265 |
| 4,422,719 | 12/1983 | Orcutt | 350/96.3 |
| 4,743,765 | 5/1988 | Ekstrand | 250/467.1 |
| 4,806,007 | 2/1989 | Bindon | 33/246 |
| 4,918,823 | 4/1990 | Santiago | 33/241 |
| 4,928,394 | 5/1990 | Sherman | 33/265 |
| 4,945,667 | 8/1990 | Rogalski | 42/100 |
| 4,993,158 | 2/1991 | Santiago | 33/253 |
| 5,001,837 | 3/1991 | Bray | 33/265 |
| 5,063,678 | 11/1991 | Simo | 33/265 |
| 5,065,519 | 11/1991 | Bindon | 33/241 |
| 5,121,462 | 6/1992 | Fabre et al. | 385/143 |
| 5,168,540 | 12/1992 | Winn et al. | 385/128 |
| 5,168,631 | 12/1992 | Sherman | 33/265 |
| 5,201,124 | 4/1993 | Sherman | 33/265 |
| 5,291,577 | 3/1994 | Zoscak | 385/147 |
| 5,435,068 | 7/1995 | Thames et al. | 33/265 |
| 5,619,801 | 4/1997 | Slates | 33/265 |

FOREIGN PATENT DOCUMENTS

| | | | |
|---|---|---|---|
| 0128753 | 1/1984 | European Pat. Off. . | |
| 470016 | 5/1992 | European Pat. Off. | 33/241 |
| 3813258 | 2/1989 | Germany | 385/147 |
| 4214997 | 11/1993 | Germany . | |
| 53-31399 | 3/1978 | Japan . | |
| 211702 | 8/1989 | Japan | 385/147 |

OTHER PUBLICATIONS

Riedel–deHaën, Technical Bulletin "Lumilux® N–pigments," Germany, Mar. 1994.

Stanislawski Archery Products, Mar. 4, 1991, "Stanislawski Archery Products Producing Winning Results".

Golden Key & Photo's—"Glow–Sight", p. 10 (date unknown).

Photos of alleged prior documents—"Prior One", "Prior Two", "Prior Three", and "Prior Four" (dates unknown).

*Primary Examiner*—G. Bradley Bennett
*Attorney, Agent, or Firm*—Jenkens & Gilchrist

[57] ABSTRACT

A variety of sighting device embodiments for use on projectile type weapons including a scope type sight for archery and barrel supporting sights for guns. Some sights utilize a predetermined length of a light gathering flourescent fiber having a distal end at which gathered light is focused. The fiber or fibers are arranged in various configurations and/or pairs in predetermined relations for exposing the ends in a sighting plane visible to the user of the weapon.

1 Claim, 14 Drawing Sheets

SIGHTING DEVICES FOR PROJECTILE TYPE WEAPONS

This is a division, of application Ser. No. 08/834,763, filed Apr. 3, 1997 now abandoned, which was a DIV of Ser. No. 08/506,722, filed Jul. 26, 1995 now U.S. Pat. No. 5,638,604, which was a CIP of Ser. No. 08/173,503, filed Dec. 23, 1993 now U.S. Pat. No. 5,442,861.

This application is a continuation-in-part of application Ser. No. 08/173,503 filed Dec. 23, 1993 and entitled "SIGHT PIN AND HOLDER FOR ARCHERY BOW."

FIELD OF THE INVENTION

The field of art to which the invention pertains comprises sighting devices providing indicia for aiming a projectile type weapon such as an archery bow and/or gun.

BACKGROUND OF THE INVENTION

Aiming sights are commonly used as a reference indicia on various weaponry such archery bows, guns, etc. For archery purposes they are available from a variety of commercial sources and/or may be provided as original equipment by the manufacture. The sight for archery usually consists of a bracket secured to a sight assembly on the bow to support a plurality of vertically spaced sight elements extending cantilevered to an end adjacent a vertical sight plane. Each of the different sight elements typically represent distinct target distances from which the archer can select in the aiming of his arrow toward an intended target. For guns, the sight usually consists of a scope, a laser sight, or a pair of aligned sighting elements mounted on the gun barrel.

BACKGROUND OF THE PRIOR ART

Because use of such weapons frequently occur under low light conditions when visibility of the sight element can become poor, if not virtually non-existent, various sight units have been developed that gather ambient light to amplify visibility. Such units for archery have generally consisted of a light enhancement sight unit disclosed, for example, in U.S. Pat. No. 4,928,394 in which metal clad fiber optic sight pins are used to create an illuminated sight bead. U.S. Pat. No. 5,168,631 discloses use of molded plastic plate members comprised of fluorescent dye translucent plastic that absorb ambient light waves, conducted to the plate edges. U.S. Pat. No. 5,201,124 discloses use of a dye impregnated light conducting plastic formed as an elongated tapered and rigid pin having a distal end to which collected light is conducted. In the parent application hereof, there is disclosed a light gathering fluorescent optical fiber that focuses gathered light at its ends with a significantly enhanced light intensity.

OBJECTS OF THE INVENTION

It is an object of the invention to provide novel sight units useful as aiming indicia for a variety of projectile type weapons.

It is a further object of the invention to provide a novel holder to enable mounting the sight unit of the previous object as a replacement on an existing sight assembly or adapted for installation on original equipment.

It is a still further object of the invention to provide a novel light gathering sight unit as in the previous objects having a sight pin affording significantly enhanced illumination at its distal ends.

SUMMARY OF THE INVENTION

This invention relates to novel forms of sighting devices for use on projectile type weapons. More specifically, the invention relates to such devices useful as a replacement, add-on, or to be installed on original equipment as the aim indicia for the weapon. By means of a selected fiber utilized in the unit, significantly enhanced light glow is provided as the aim indicia even under relatively low light conditions.

The foregoing is achieved in accordance with the invention utilizing a predetermined length of pin formed of a fluorescent dye fiber composition. An enlargement at the distal end of the fiber comprises a lens that serves as the aim point indicia of the sight unit and can be mounted singularly or in cluster forms via mounting structures appropriately suitable for the various types of weapons. The fiber can be of a type known as a fluorescent optical fiber or a scintillating fiber characterized as absorbing ambient light through the body which focuses to a bright glow at the lens comprising the aim point indicia. The superior brightness, smaller size, unique fiber shape, lens and distinctive fluorescent colors distinguish the fiber hereof from other commercially available sight pin products. A protective transparent sleeve can be utilized over a partial length of the fiber where secured by a holder or bracket.

The holder or bracket serves to mount and secure the fiber onto an assortment of sight assemblies and may be comprised of a clear polycarbonate, acrylic, or other clear or transparent composition uniquely shaped to receive and secure the fiber while accommodating selective position settings of the aim point indicia. Being adjustably settable, the holder for archery applications can be oriented and positioned by the archer on the sight assembly so as to place the fiber aim point in a location preferred and selected by the archer.

A multiplicity of sight holders and fiber aim points can be assembled to create multiple aim points on a particular sight assembly. Holders for that purpose can be arranged in various configurations to create very close groupings of aim points that function as separate distance indicators on the sight unit.

For gun applications, the holder typically supports the pin along the barrel by adapting existing sight units or substituting an appropriate add-on unit.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENT

Figure 2:
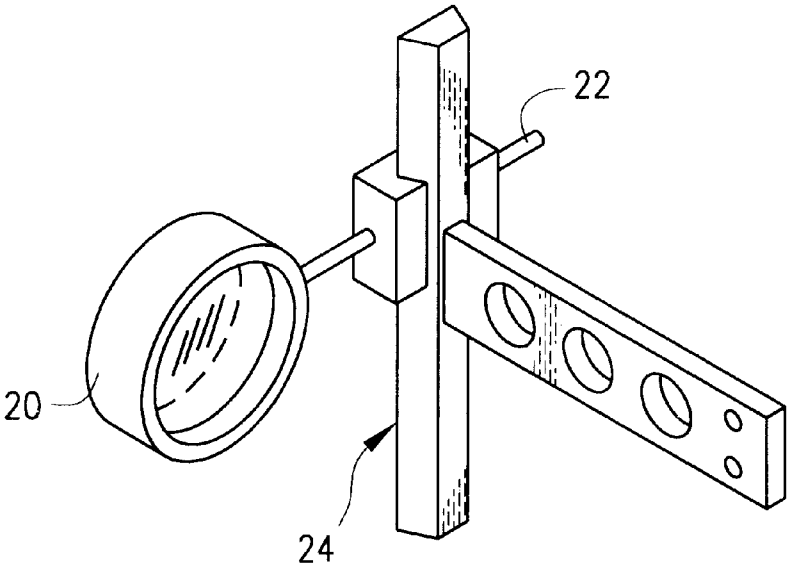
FIG. 2 (PRIOR ART)
FIG. 2 is a vertical perspective view of a scope type sight unit of a prior art archery bow set.

In the description which follows, like parts are marked throughout the specification and drawings with the same reference numerals respectively. The drawing figures are not necessarily to scale and in certain views, parts may have been exaggerated for purposes of clarity.

Figure 1:
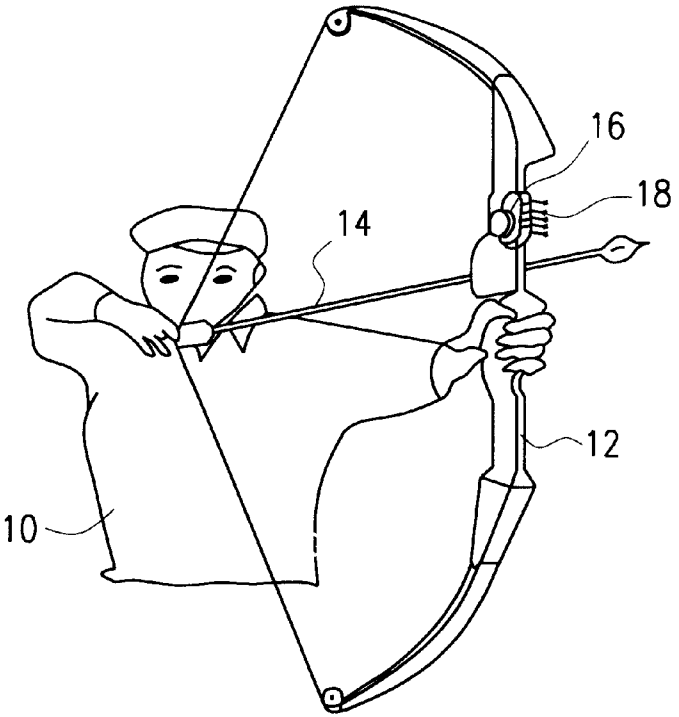
FIG. 1 (PRIOR ART)
FIG. 1 is a vertical perspective view of a prior art archery bow set.
Figure 4:
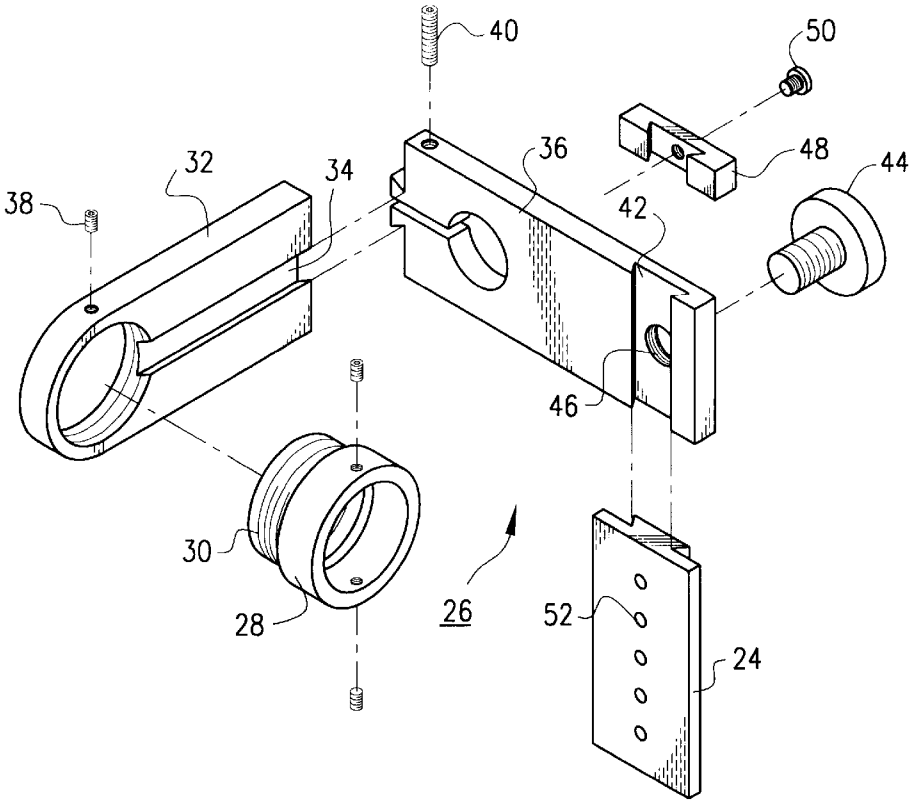
FIG. 4 is an exploded perspective view of the sight unit of FIG. 3.
Figure 3:
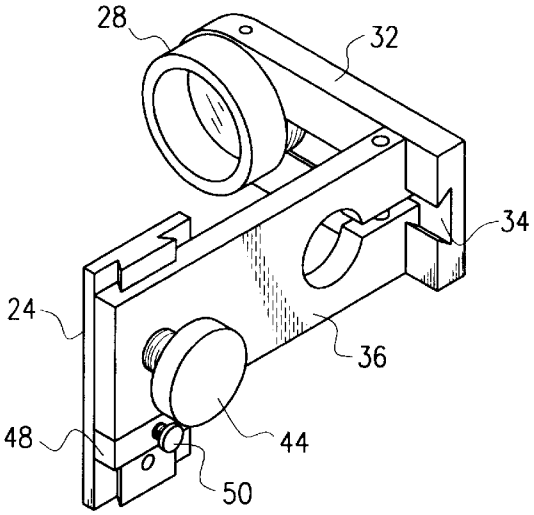
FIG. 3 is a perspective view of an archery bow scope sight of the invention.

Referring now to drawings, there is illustrated in FIG. 1 an archer 10 operating a bow 12 for the aimed release of arrow 14. Supported on the bow is a sight assembly 16 containing a multitude of sight pins 18. In FIG. 2, a scope type sight assembly 20 of the prior art includes an elongated threaded rod 22 secured to a typical dovetail sight holder 24. The rod 22 is usually constructed of either stainless steel or titanium but by virtue of its cantilevered extension from the sight holder, tends to incur high levels of vibration and ultimate fatigue from which failure results.

Referring now to FIGS. 3–12, there is disclosed a form of scope construction in accordance with the invention hereof designated 26 that eliminates the fatigue failure of the prior art. Specifically, scope 26 includes a tubular housing 28 threadedly connected via threads 30 to a rigid arm plate 32 having a dovetail slot 34 for receiving a rigid extension arm 36. A set screw 38 secures housing 28 in position whereas a set screw 40 enables presetting the tension of arm 36 in slot 34 and thereafter securing the relative positions thereof. Dovetail slot 42 enables the position setting of arm 36 on the sight holder 24 while a lock knob 44, threadedly secured in threaded aperture 46, enables the selected position to be secured. A sight stop 48 secured on sight holder 24 immediately underlying arm 36 includes a set screw 50 that extends in a compression pressure stop against holder 24 to afford a reference location on subsequent re-assembly. Bores 52 enable the holder 24 to be attached to the bow.

Being that the entire unit 26 is comprised of rigid components with scope 28 being secured directly to arm plate 32, the previous problem associated with fatigue failure in the manner of the prior art is thereby overcome. Within housing 28 is an aiming indicia to be described. With a different orientation arm plate 32 can be connected directly to sight holder 24 thereby eliminating extension arm 36. Arm plate 32 can also be mounted directly on the bow as will be described below. As can be appreciated, the screw mounted housing not only solves the fatigue problems of the prior art, but at the same time simplifies setting the vertical orientation of the pins particulary where an archer is predisposed to canting the bow when shooting.

Figure 6:
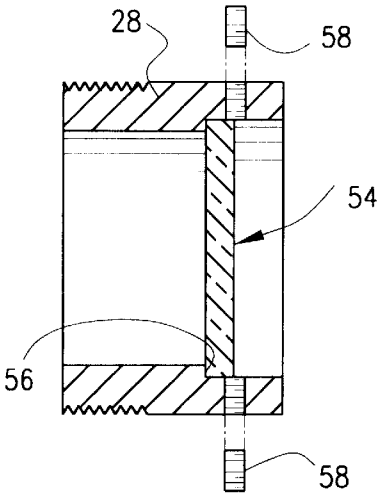
FIGS. 5 and 6 are front and sectional elevations respectively for a modified form of scope sight as utilized in the unit of FIG. 3.
Figure 5:
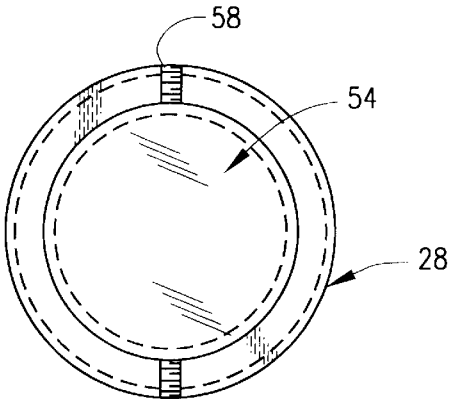

As shown in FIGS. 5 and 6, scope housing 28 includes a lens 54 inwardly positioned against a shoulder 56 and secured thereat via opposite set screws 58. The aiming indicia (not shown) can be as known in the prior art or as will be further described below.

Figure 9:
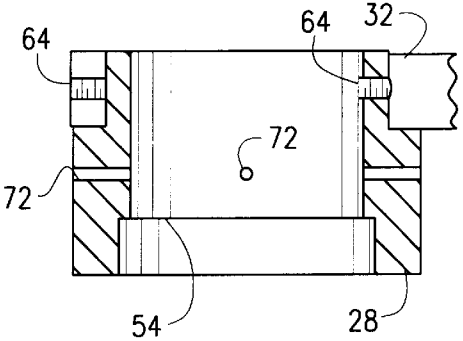
FIGS. 7, 8, and 9 are vertical sections of further modifications for the sight unit of FIG. 3.
Figure 8:
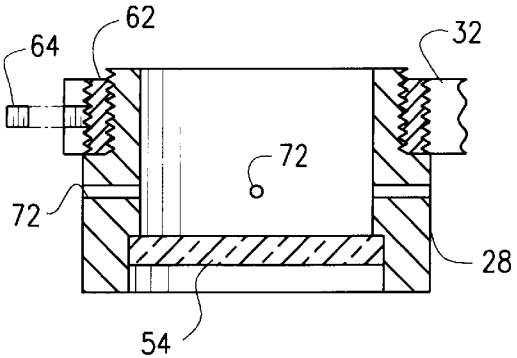
Figure 7:
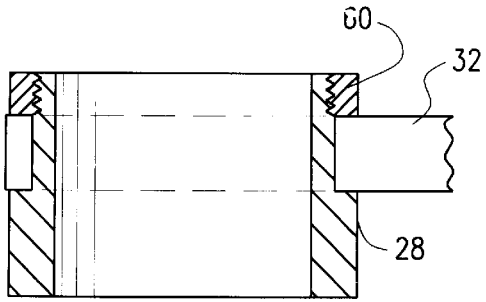
Figure 10:
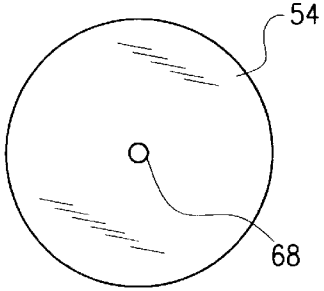
FIG. 10 is a front elevation of a modified scope lens as utilized in the scope modifications of FIGS. 8 and 9.
Figure 11:
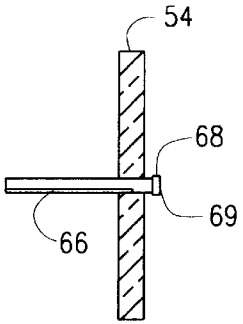
FIGS. 11 and 12 are sectional elevations disclosing optional features for use with the scope lens of FIG. 10.
Figure 12:
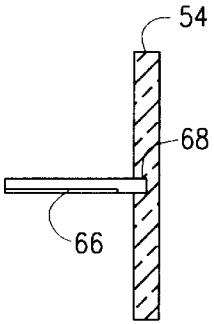

FIGS. 7, 8, and 9 illustrate optional variations for securing housing 28 to arm plate 32. In FIG. 7, the housing is secured by a threaded lock ring 60 while in FIG. 8 there is included a cushioning ring 62 of silicone rubber or other suitable vibration dampening material that can be of a bushing configuration and secured via a set screw 64. FIG. 9 provides a slideable interfit secured by opposite set screws 64 and is adapted to accommodate a lens 54 along with an optical light gathering fluorescent fiber 66, having an end 68 at which gathered light is focused (FIG. 10). Side bores in housing 28 accommodate insertion of fiber 66 as will be described below. As shown in FIG. 11, the fiber 66 penetrates the lens with end 68 extending beyond the lens face thereat and which may include a fiber lens 69 on end 68. In FIG. 12, the fiber penetrates only partially into the lens with end 68 remaining visible to the operator of the weapon on which it is exposed. For reasons as will be understood, housing 28 is preferably of a clear acrylic, polycarbonate or other transparent composition while the fiber per se may be enclosed in a thin transparent protective sleeve such as polyethylene so as to maximize exposure of the fiber therein to the ambient light.

Fiber 66, as more completely disclosed in the parent application hereof, is comprised of about a two to four inch length of fluorescent dye polymer having a diameter of approximately 0.030 inches that typically varies from about about 0.020 to 0.080 inches up to about 4 inches in length. For certain applications the fiber length can be even shorter or longer. It is of a composition characterized as light gathering along its length to conduct and focus gathered light at its opposite ends 68 so as to be operative in the manner herein as an aim point indicia. Such fibers in coil form are available from commercial sources such as Optecron Inc. of Raynham Mass under the trademark "Plastifo" and may be of a type disclosed for example in U.S. Pat. No. 5,121,462.

Fiber elements of this type are sometimes identified as fluorescent optical fibers or scintillating optical fibers and typically comprise a polymer base such as a polystyrene core, PMMA (polymethylmethacrylate) core or polycarbonate core to which a flourescent dopant has been added along with or without a fluoropolymer cladding. The dopant is chosen so as to cause fiber light absorbtion over a specific wave length that is transformed into a longer wave length that is reemitted in amplified form at the extremities. The thin cladding (not shown) is usually of a lower refractive index than the fiber for improving light transmission along its length and to focus the light to an astounding brightness at its distal end 68. Commercially, the fiber is commonly available in coiled lengths which are cut to size. For purposes hereof, the fibers may be bent and may include a lens 69 mentioned supra. Optimum brightness occurs at a length of approximately one meter, such that the shorter the length the less quantity of light is emitted at distal end 68.

Figure 15:
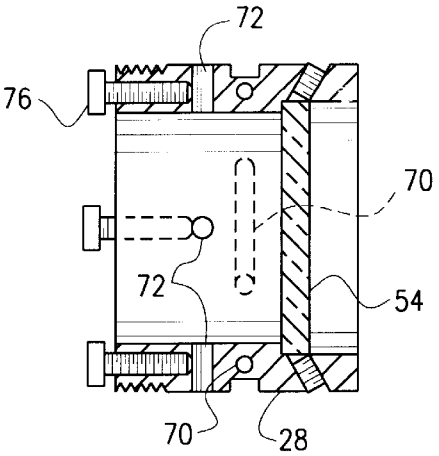
FIG. 15 is a side sectional elevation of the housing of FIG. 13.
Figure 13:
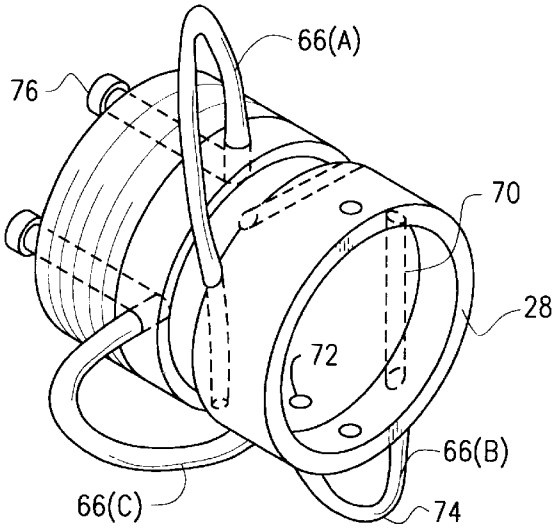
FIG. 13 is an perspective view of a scope housing of FIGS. 8 or 9 utilizing a scope lens and a multiplicity of light gathering fluorescent fiber sight pins.
Figure 14:
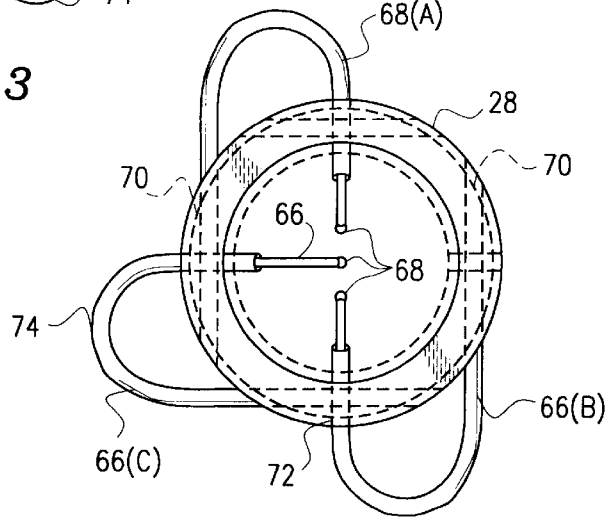
FIG. 14 is a front elevation of the scope housing of FIG. 13.

A scope housing 28 incorporating a plurality of fibers 66, each preferably of different color, can best be understood with reference to FIGS. 13–15. As thereshown, each of the separate fibers here designated 66 (A), (B), and (C) extend into separate elongated inlet bores 70 in the housing. From bore 70, each fiber emerges in a U-shape bend before re-entering the housing through an inlet bore 72 from which it emerges in an offset bend to an end 68 interior of the housing. Set screws 76, when backed off, permit adjustable positioning of the sleeved or unsleeved fiber in the bore 72 such that after ends 68 have been aligned in a predetermined pattern within the sight plane in the manner of FIG. 14, the position settings can be secured by the respective set screws.

Figure 16:
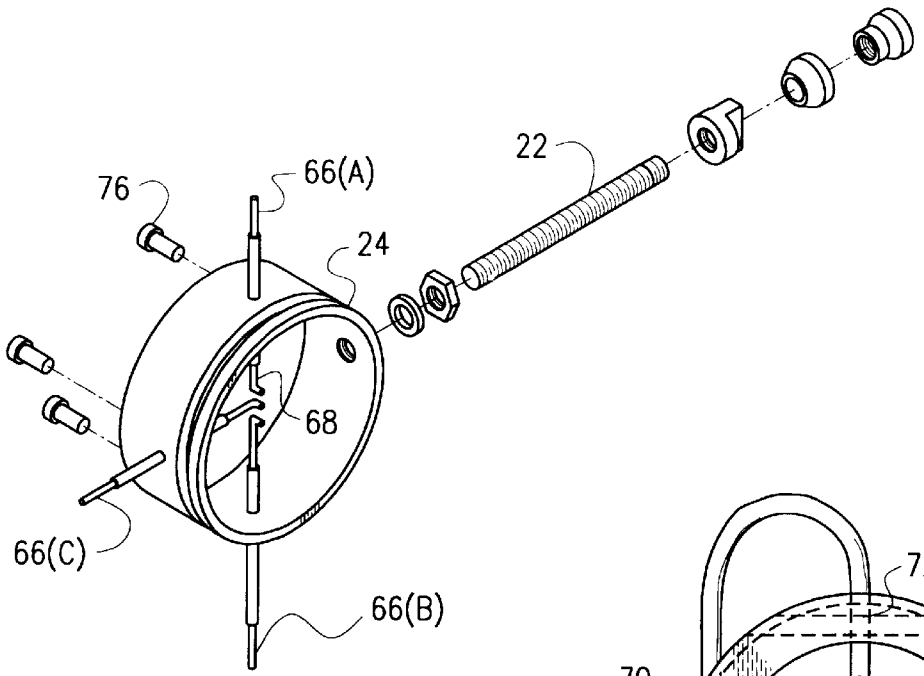
FIG. 16 is an exploded perspective view of a housing construction for accommodating a plurality of light gathering fluorescent fiber sight pins.
Figure 17:
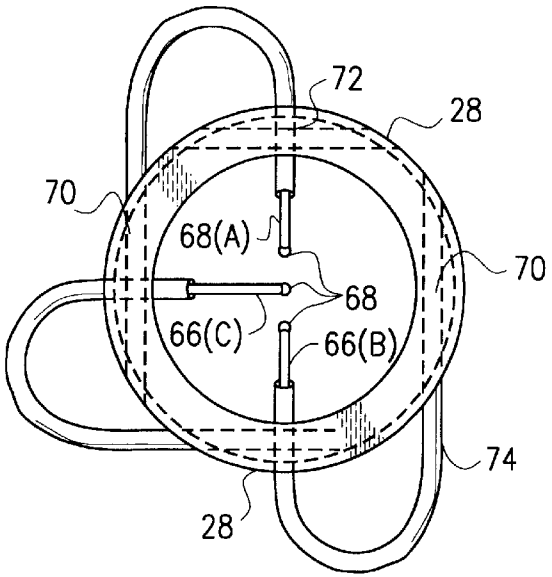
FIGS. 17 and 18 are front and sectional elevations respectively for the assembled sight housing of FIG. 16.
Figure 18:
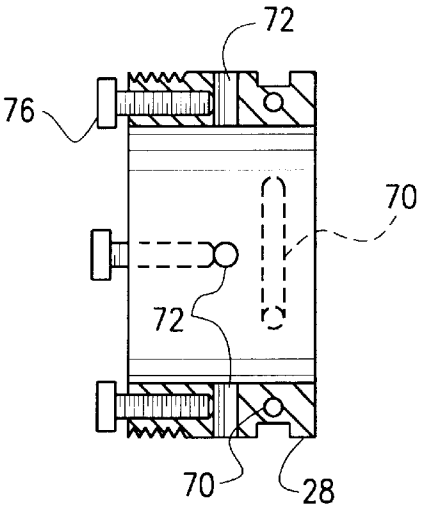
Figure 19:
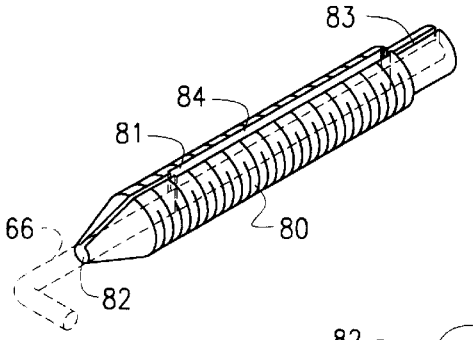
FIG. 19 is a perspective view of a pin and holder assembly for use with archery sights.
Figure 20:
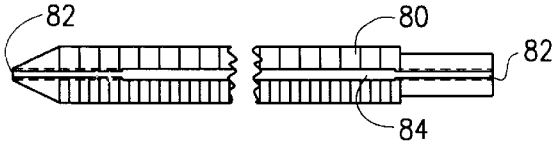
FIGS. 20 and 21 are top and sectional views respectively of the holder of FIG. 19.
Figure 21A:
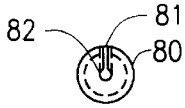
Figure 21:
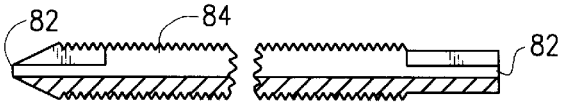

FIG. 16 is a partially exploded view illustrating initial assembly for a lens free scope sight housing 28 which when completely assembled include fibers 66 arranged in the manner of FIGS. 17 and 18.

With reference to FIGS. 19–23, there is shown variations of a threaded sleeve-like holder 78 as disclosed in the parent application hereof and which can be either transparent or opaque. Preferably, the body 80 is comprised either of metal or clear plastic peripherally threaded and includes an elongated central bore 82 in which to receive and retain a fiber pin 66. As further modified herein, the embodiment of FIGS. 19–21 includes front and rear slots 81 and 83 respectively and a centrally enlarged groove 84 extending between distal bores 82 and upstanding through the threads to the outer body surface. Use of the grooves enhance positioned placement and securing of a fiber pin 66 therein.

Figure 22:
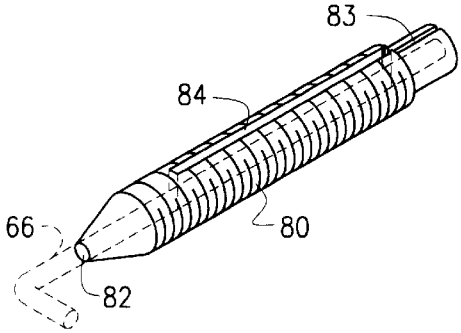
FIG. 22 is a perspective view of a modified holder of a type disclosed in FIG. 19.
Figure 23:
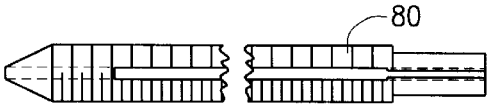
FIGS. 23 and 24 are top and sectional views respectively of the holder of FIG. 22.
Figure 24A:
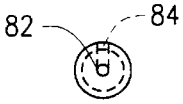
Figure 24:
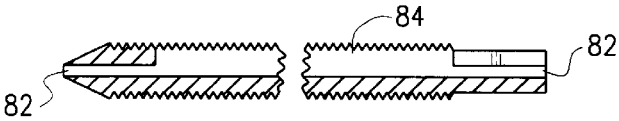
Figure 24B:
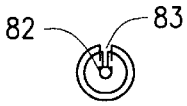

The embodiment of FIGS. 22–24 is similar to the above but lacking end slot 81.

Figure 25:
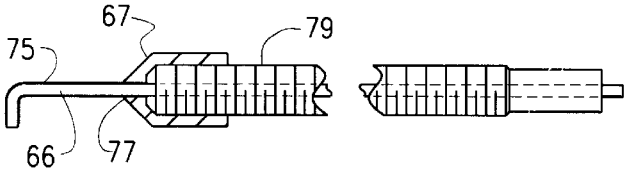
FIGS. 25 and 26 are alternate forms of pin and holder assemblies for use with archery sights.
Figure 26:
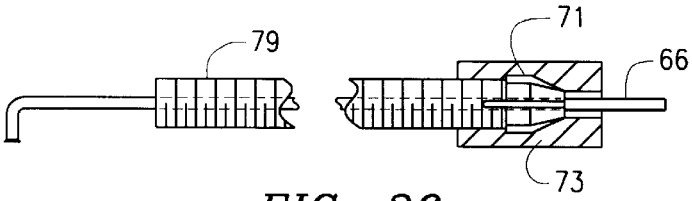
Figure 26A:
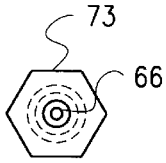

The embodiment of FIGS. 25 and 26 represents an improved and modified form of pin and holder in which a portion of pin 66 extends into the sight plane and is disposed within a length of stainless steel tubing 75. The tubing affords the pin rigidity and protection against breakage with little if any adverse affects from heat or cold. The remainder of the pin is disposed within the bore 77 of a threaded tubular and transparent body 79. The fiber 66 may be secured by a threaded front end cap 67. In the absence of the end cap, the stainless steel tubing can be secured force fit or bonded within body 79. In FIG. 26 the stainless steel tubing may be ommitted and the rear end of body 79 provided with slits 71 to form a collet that can be compressed by nut 73 to secure the fiber pin in place.

Figure 28:
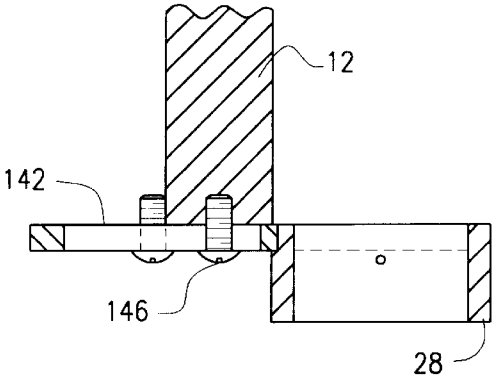
FIG. 28 is a reduced sectional view as seen substantially along the lines 28—28 of FIG. 27.
Figure 29:
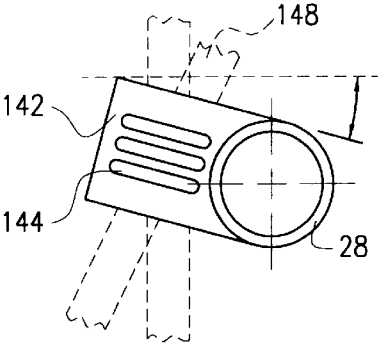
FIG. 29 is a reduced view of FIG. 27 for illustrating optional settings to effect angle variations.
Figure 27:
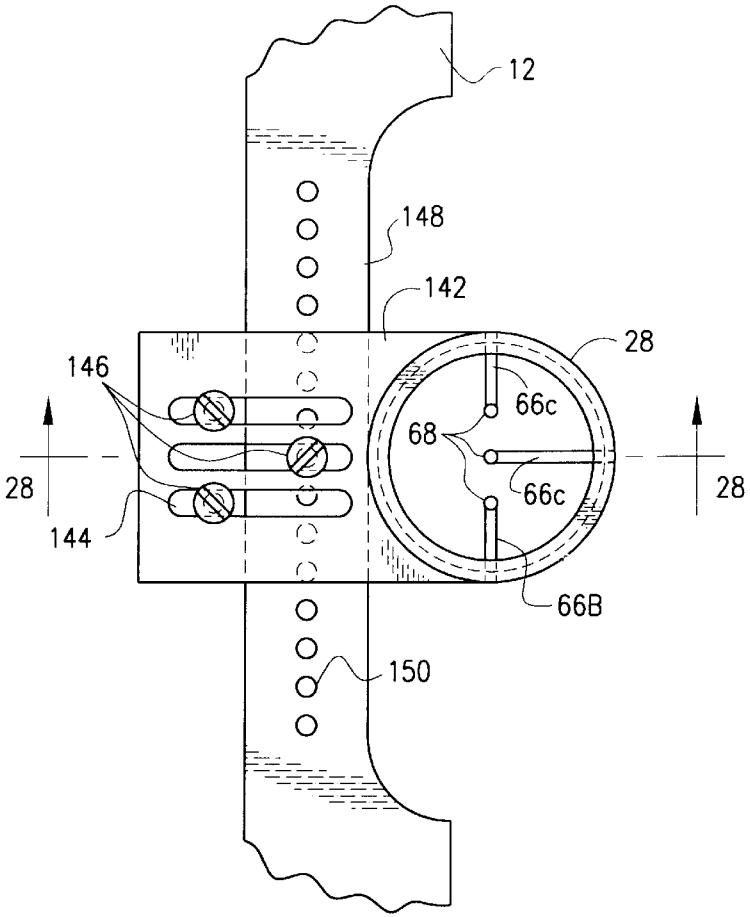
FIG. 27 is an elevation view of a pin and holder assembly for direct mounting onto an archery bow.

Referring now to FIGS. 27–29 there is illustrated another form of support for a scope housing 28 threadedly secured in a rigid arm bracket 142. In this arrangement the bracket includes a plurality of elongated horizontal slots 144 by which the bracket can be secured via screws 146 directly to the riser face 148 of bow 12. Within the bow window comprising the riser face are a plurality of uniformly spaced threaded apertures 150 to accommodate various incremental position settings of the bracket. In FIG. 29 there is illustrated a method of fine tuning the adjustment setting by tilting the unit and rotating the scope housing to maintain levelness to the horizon. It can also be used to allow canting of the bow, which some archers prefer while maintaining level orientation of the sight pin arrangement.

Figure 31:
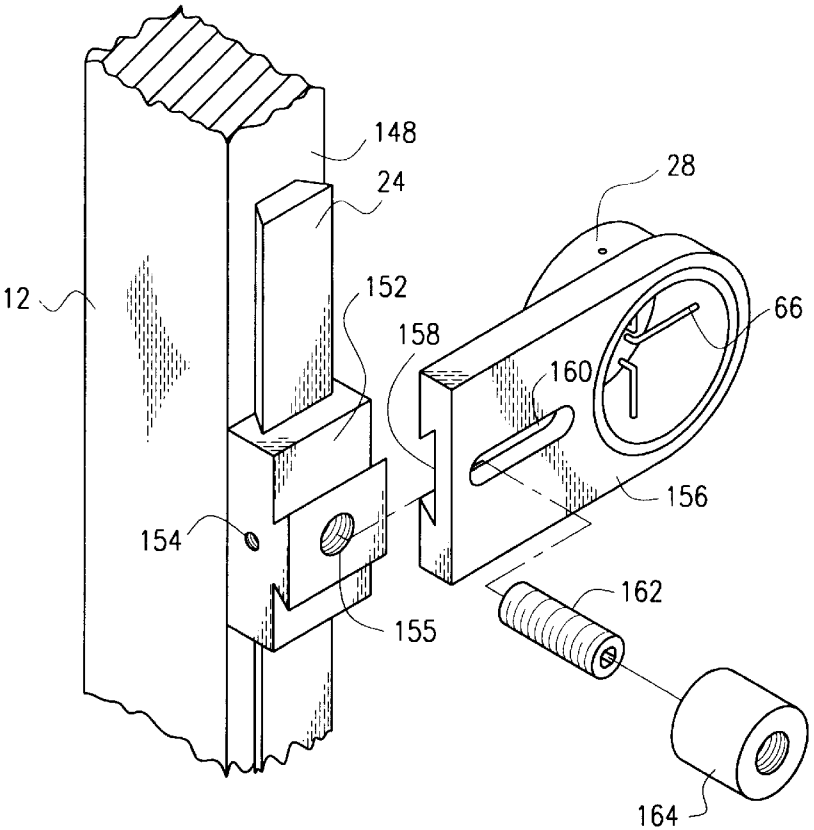
FIG. 31 is an exploded view of the assembly of FIG. 30.
Figure 30:
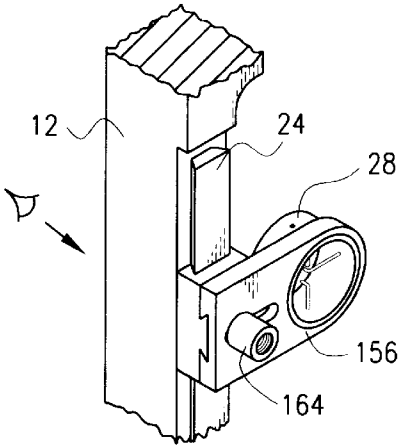
FIG. 30 is an elevation view of another alternate pin and holder assembly for direct mounting onto an archery bow.
Figure 32:
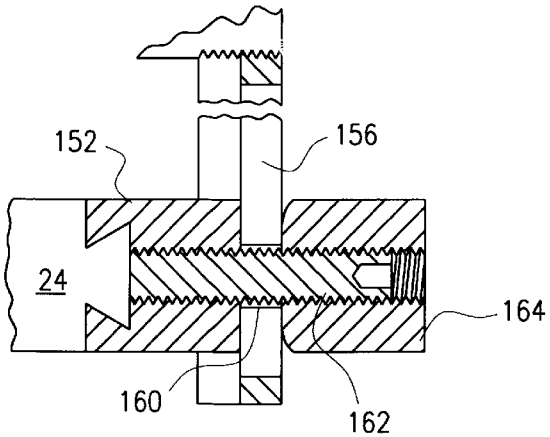
FIG. 32 is a fragmentary sectional view through the sight elevation slide of FIG. 31.

In the structural arrangement of FIGS. 30–32 there is provided a dovetail holder 24 secured to riser face 148. Slideably supported on holder 24 is a dovetail slide 152 having threaded apertures 154 and 155. Bracket 156 receives scope housing 28 and includes a dovetail 158 for effecting a slideable interfit with slide 152. Also provided in bracket 156 is an elongated slot 160 through which screw 162 and lock knob 164 threaded into aperture 155 can presettably secure selected lateral positioning of housing 28 in the sight plane.

Figure 61:
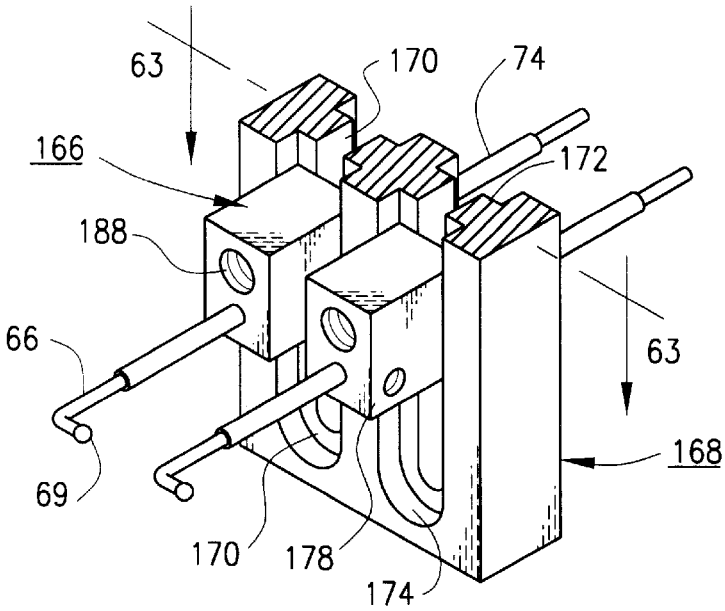
FIG. 61 is a perspective view of a sight pin adapter for a grooved type archery sight.
Figure 62:
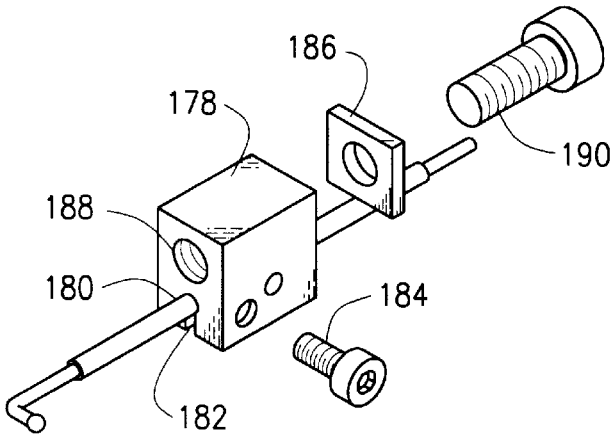
FIG. 62 is an exploded perspective view of the sight pin adapter of FIG. 61.
Figure 63:
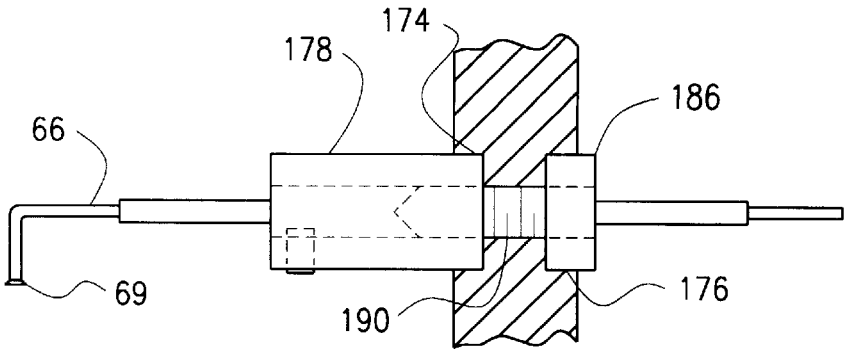
FIG. 63 is a sectional plan view taken substantially along the lines 63—63 of FIG. 61.

FIGS. 61–63 illustrate sight pin adapters 166 for a grooved type sight archery holder 168. The holders are comprised of a plurality of vertically elongated slots 170 having oppositely inward center posts 172 so as to define a front groove 174 and a rear groove 176. Each adapter 166 is comprised of a rectangular body 178 having a longtitudinal bore 180 in which a fiber pin 66 in a transparent sleeve 74 is disposed. The underside of body 178 may include a slot 182 acting as a jaw that can be operated via a set screw 184 to secure or release pin 66 in bore 180.

For mounting the adapters, the rear end of body 178 is positioned at a a selected height in front groove 174 while a square nut 186 is positioned in rear groove 176 in axial alignment with threaded body bore 188. A screw or bolt 190 can then be used to draw the body and nut into a tight fitting engagement within their respective grooves.

Gun applications in a variety of different embodiments are illustrated in FIGS. 33–60 relating to a rifle 86 or a pistol 88 having a barrel 98 with a front sight 96 and a rear sight 92 modified and/or constructed in accordance herewith.

As shown in FIGS. 37–41, rear sight 92 includes a predetermined length of fiber 66 enclosed in sleeve 74. The fiber is arranged U-Shaped for opposite ends 68 to terminate in a pair of aligned apertures 100 provided in the upstanding portions of rear sight 92 on either side of v-groove 94. Screw 108, extending into block 110 on barrel 98, secures the U-shape fiber 66 in place.

Cooperating with rear sight 92 for the purpose of establishing an aim is a front sight 96 in which the normal sight blade has been replaced by a holder 102 secured to the gun barrel. Included in holder 102 is a longitudinal rectilinear slot 104 in which to receive a transparent plastic cartridge 106 containing a fiber 66 embedded therein. The fiber end 68 in cartridge 106 is exposed to the archer centrally intervening in a sight plane through groove 94 in the rear sight 92.

Figure 44:
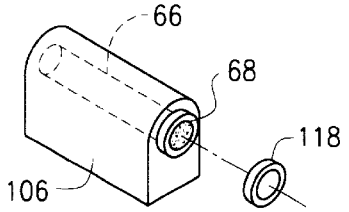
FIG. 44 is a perspective view of a modified pin construction as utilized in the front sight unit of FIG. 36.
Figure 41:
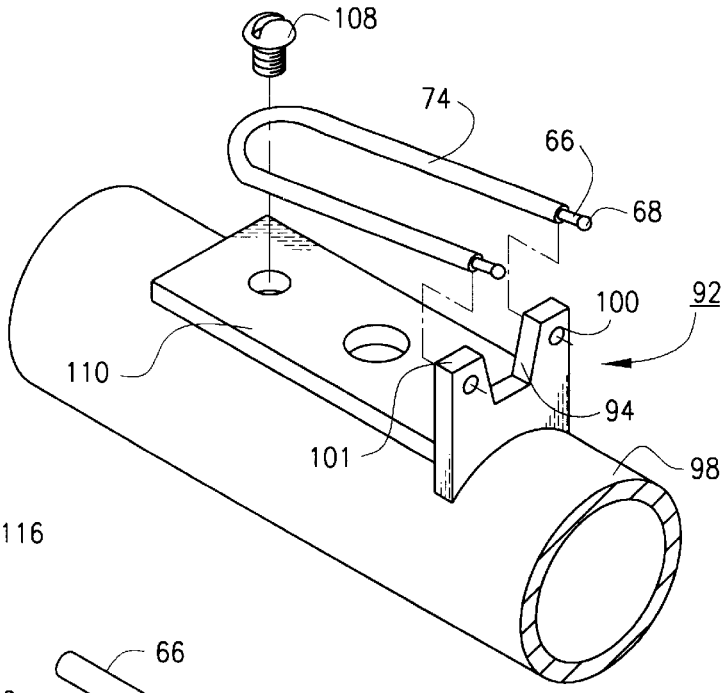
FIG. 41 is an enlarged and exploded perspective view of the rear sight assembly for the sight unit of FIG. 36.
Figure 42:
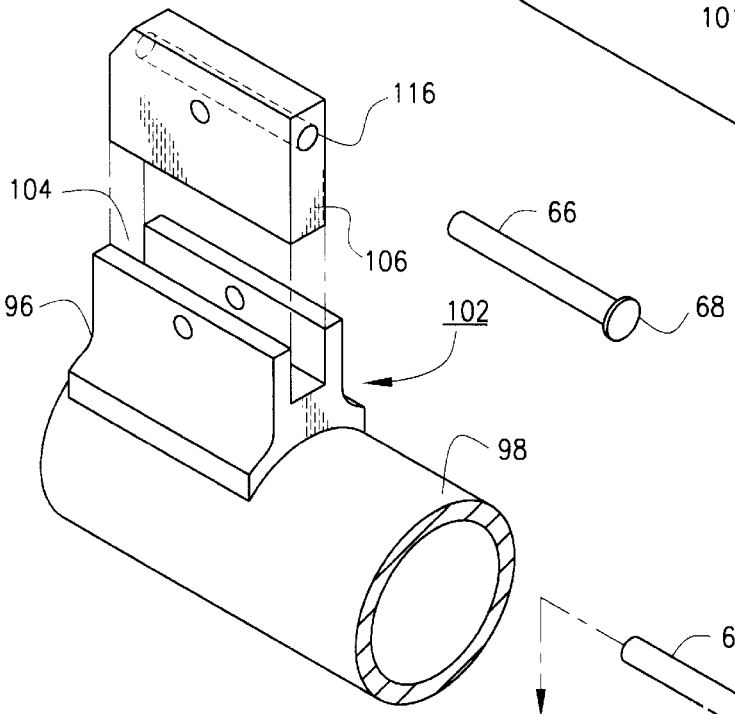
FIGS. 42 and 43 are exploded perspective views respectively of the front sight assembly on the sight unit of FIG. 36.
Figure 43:
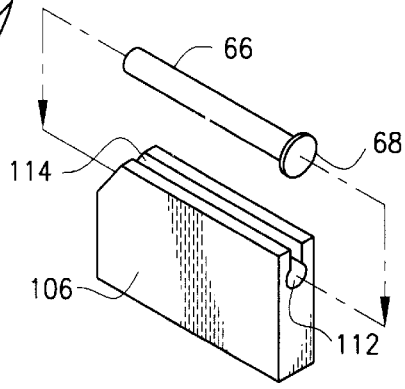
Figure 43A:
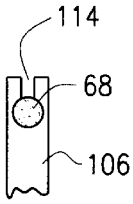
Figure 46:
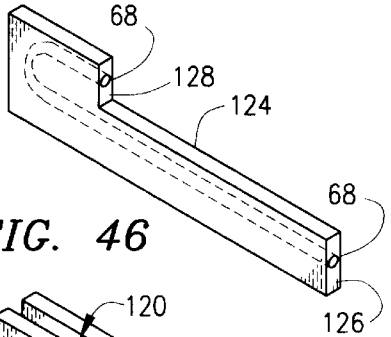
FIG. 46 is a a perspective view of a sight unit cartridge insert for use with the holder of FIG. 45.
Figure 45:
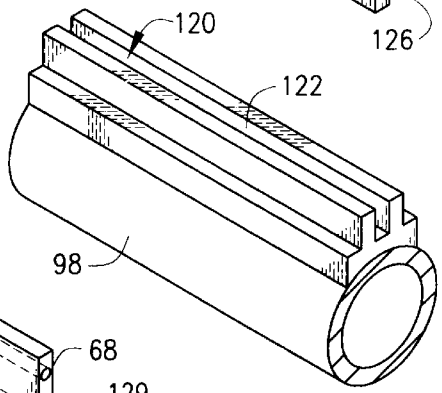
FIG. 45 is an exploded perspective view of a sight holder embodiment for use on a pistol or rifle.

As illustrated in FIG. 43, the top portion of cartridge 106 can include a longitudinal bore 112 openly communicating via a longitudinal slot 114 to enable snap-in placement of fiber pin 66. In FIG. 42, cartridge 106 includes a longitudinal bore 116 into which pin 66 can be slidably inserted. In FIG. 44 there is illustrated a combination sight in which cartridge 106 supports pin 66 in the manner of FIG. 42 but includes a radio-active tritium ring 118 secured to the front face of block 106 surrounding fiber end 68. Tritium, for this purpose, is of a type commercially available and generally usable to afford radio active night viewing in combination with pin 66 that affords day viewing. This therefore affords indicia sighting for use with weapons requiring visibility under both day and night conditions.

Figure 48:
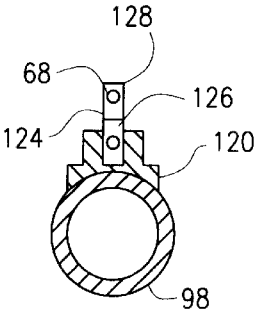
FIG. 48 is a rear sectional elevation view of the sight unit of FIG. 47.

Various alternative embodiments are disclosed in FIGS. 45–60. In the embodiment of FIGS. 45–48, barrel 98 supports a single elongated holder 120 extending essentially front to rear. The holder includes a longitudinal slot 122 for receipt of a cartridge 124 in which a length of fiber pin 66 is embodied in a "J" formation. The cartridge can be any suitable composition affording ambient light exposure to the pin. In this arrangment, one fiber end 68 is exposed at the rear cartridge face 126 while the other fiber end 68 is exposed at the front cartridge face 128. In this manner, the aiming indicia of the vertically stacked ends 68 appear when aligned in the sighting planes as best seen in FIG. 48.

Figure 33:
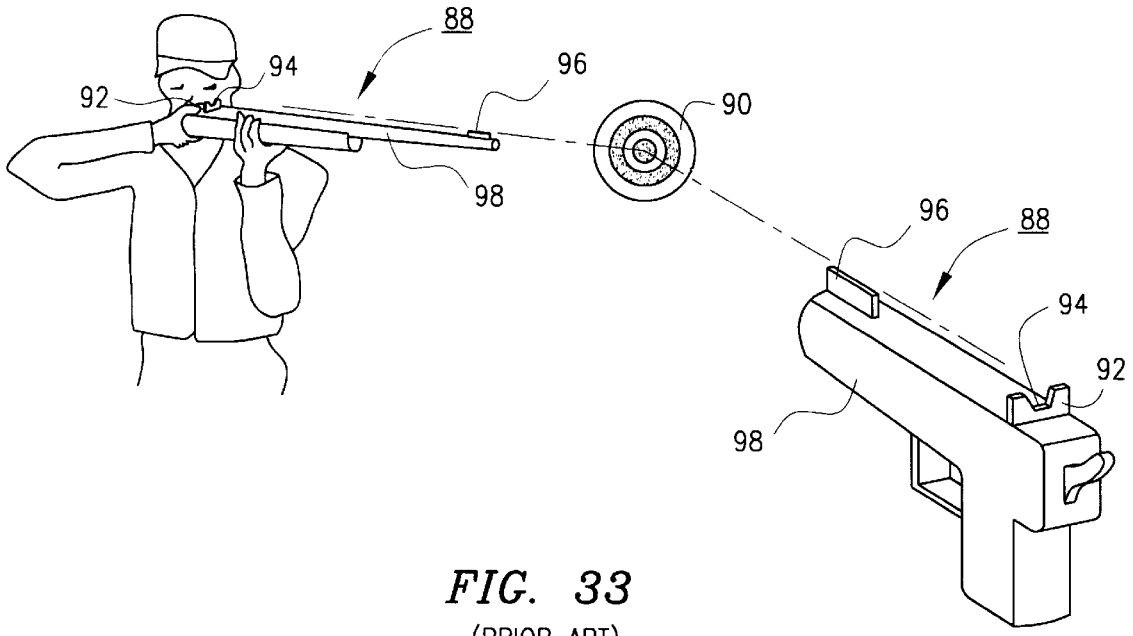
FIG. 33 (PRIOR ART)
FIGS. 33, 34 and 35 are sight units of a type typically utilized for aiming indicia on a rifle or pistol of the prior art.
Figure 34:
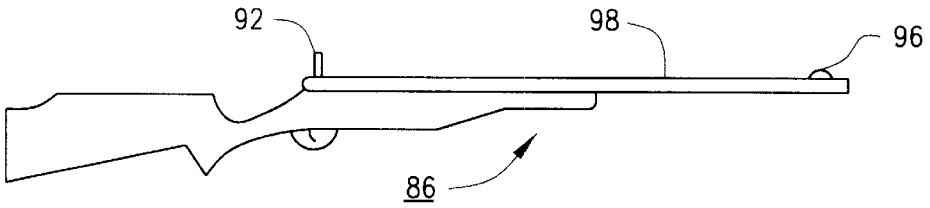
FIG. 34 (PRIOR ART)
Figure 35:
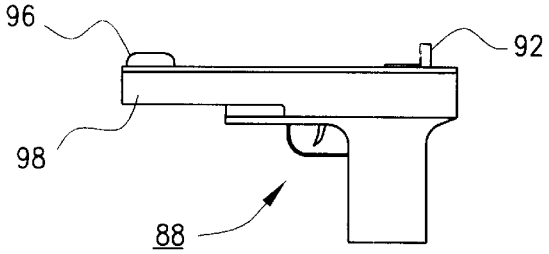
FIG. 35 (PRIOR ART)
Figure 36:
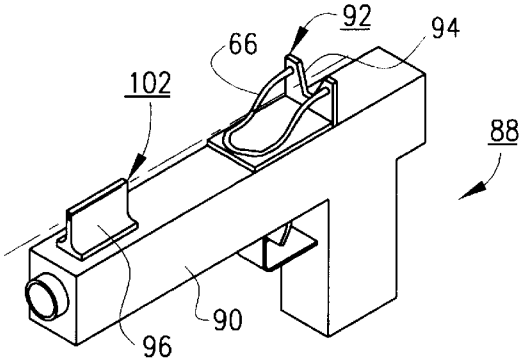
FIG. 36 is a perspective view of a pistol utilizing a further embodiment of the light gathering sight unit hereof.
Figure 38:
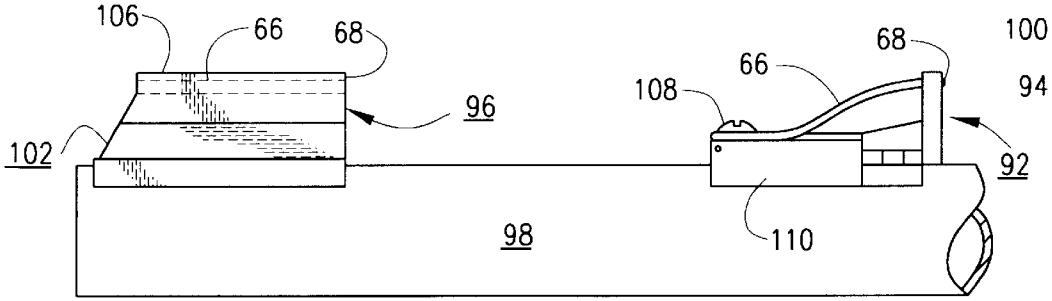
FIG. 38 is a side elevation of the sight unit of FIG. 36.
Figure 40:
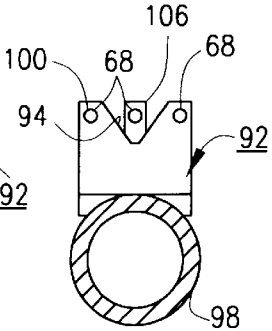
FIGS. 39 and 40 are front and rear end elevation views respectively of the sight unit of FIG. 36.
Figure 37:
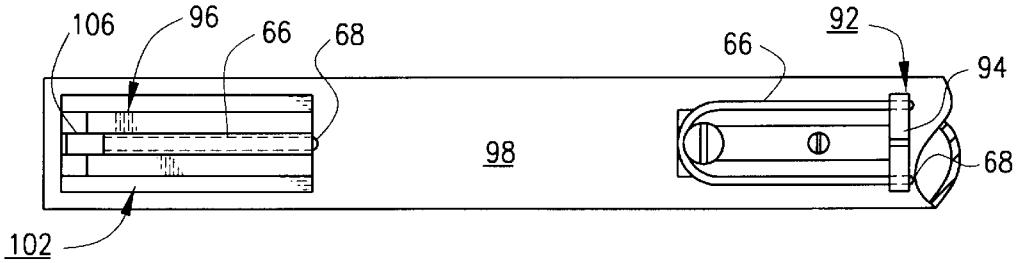
FIG. 37 is a top plan view of the sight unit of FIG. 36.
Figure 39:
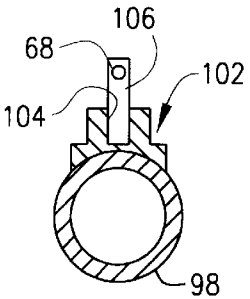
Figure 49:
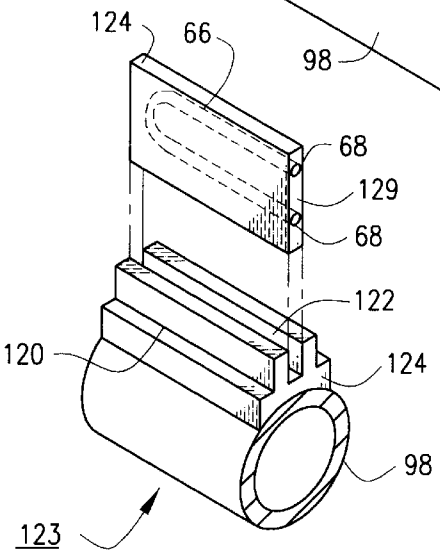
FIGS. 49, 50 and 51 are similar to the FIGS. 45–48 utilizing a modified form of sight unit.
Figure 47:
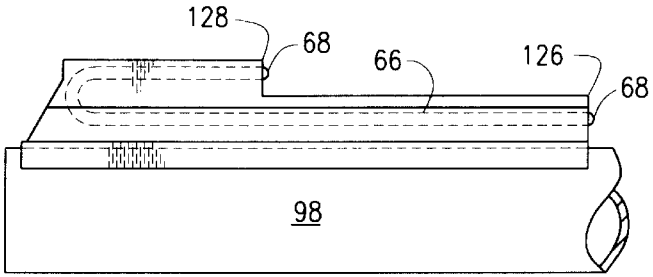
FIG. 47 is a side elevation view of the assembled holder and sight unit of FIGS. 45 and 46.
Figure 50:
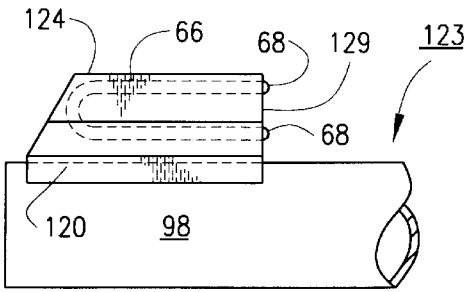
Figure 51:
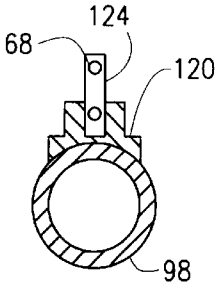

The embodiment of FIGS. 49–51 is a front sight only usable in combination with a conventional rear sight as illustrated in FIGS. 33–35. Front sight 123 is similar to the preceding except that the fiber pin 66 herein is embedded in a clear cartridge 124 with the fiber in a vertically oriented "C" shaped formation so as to expose both ends 68 in a predetermined vertical separation at a common face 129. Where it is preferred to utilize only one fiber end 68, the other end can be blocked by well known techniques.

Figure 52:
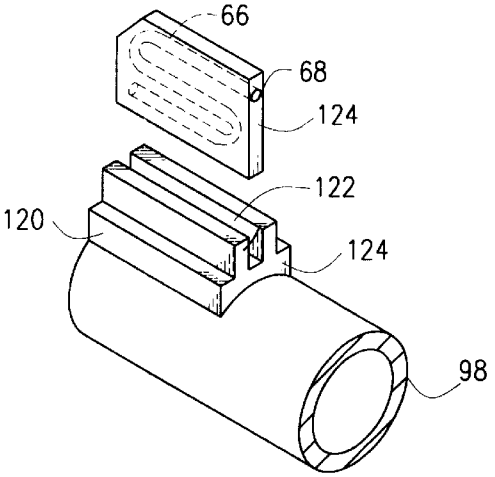
FIGS. 52, 53 and 54 are similar to FIGS. 45–48 utilizing a further modified form of sight unit.
Figure 53:
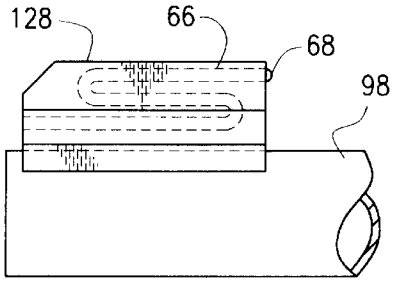
Figure 54:
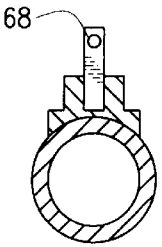

The embodiment of FIGS. 52–54 is likewise similar to the preceding embodiment for a front sight only except that fiber pin 66 is in a vertically oriented "S" formation such as to afford greater length for exposure to ambient light than the "C" shape of the previous embodiment.

Figure 55:
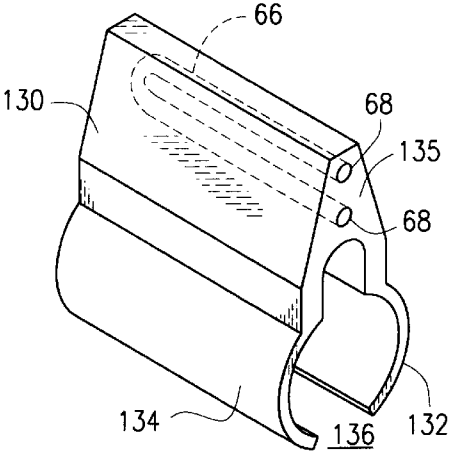
FIG. 55 is a perspective view of a detachable holder and sight unit combination.
Figure 56:
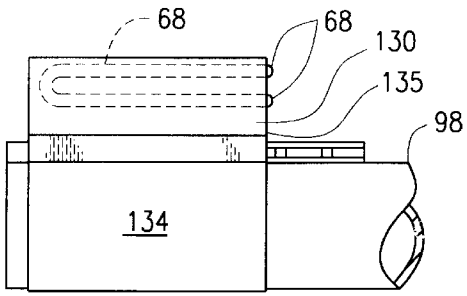
FIG. 56 is a side elevation view of the sight pin and holder of FIG. 55.
Figure 57:
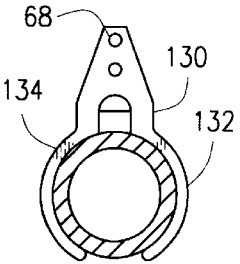
FIG. 57 is an end elevation view of the sight pin and holder of FIG. 56.

For the embodiment of FIGS. 55–57, there is provided a front sight in the form of an integral snap-on holder 130. The holder is comprised of longitudinal and parallel, spaced apart arcuate side fingers 132 and 134 separated by a longitudinal gap 136 along their distal edges. This enables the holder to have a unitized structure which functions as a detachable snap-on sight having a U-shaped fiber 66 affording a fiber end 68 at face 135 for sighting.

Figure 60:
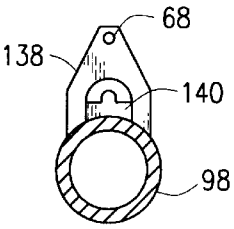
FIG. 60 is an end elevation view of the sight unit of FIG. 59 adapted to interfit over an existing vent rib on a gun barrel.
Figure 59:
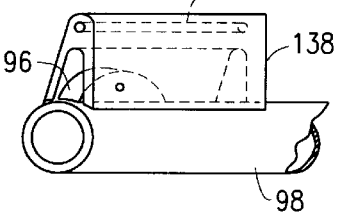
FIG. 59 is a side elevation view of a holder and sight pin unit for mounting onto an existing front gun sight.
Figure 58:
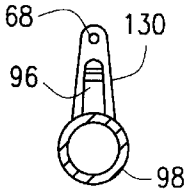
FIG. 58 illustrates an end elevation of a modified form of snap-on sight pin unit similar to FIG. 55 for mounting onto an existing front gun sight.

In the embodiment of FIGS. 58 and 59, a front sight holder 138 is longitudinally and centrally spread so as to interfit over an existing front blade sight 96. In FIG. 60, the holder 138 is adapted for interfitting over an existing vent rib 140 of a gun barrel 98.

By the above description there is disclosed novel apparatus for enhancing the aiming indicia on a projectile type weapon such as an archery bow or gun. Use of a scope type sight with or without a light gathering pin is disclosed that affords the benefit of increased life expectancy by virtue of eliminating fatigue failure typical of scope type units of the prior art. When utilized with a light gathering fluorescent fiber in a variety of different arrangements, significant light enhancement is afforded to the aiming indicia under a wide range of varying light conditions. Various sight embodiments are specifically adapted for gun use affording vast enhancement for sighting, particularly under conditions of low light. Yet the improvements and innovations of the various embodiments disclosed herein are relatively inexpensive to the end user so to not render them cost prohibitive while realizing the benefits that such fiber pins afford. The virtues are many in resolving long felt needs in the field of user sighting with projectile type weapons.

Whereas the use of specific holding structures have been disclosed for securing the fluorescent fiber in place, it is contemplated that adhesives and/or cements can likewise be utilized for that purpose with or without a specific form of holder. Also, whereas the term "weapon" has been employed herein as representing the contemplated majority of applications with which the aiming devices hereof will be utilized, it is not intended to be limited thereto. Rather, it is intended that the term "weapon" embrace any other form of device in which aiming is resorted to including, for example, various forms of children's toys, video games, etc.

Since many changes could be made in the above construction and many apparently widely different embodiments of this invention could be made without departing from the scope thereof, it is intended that all matter contained in the drawings and specification shall be interpreted as illustrative and not in a limiting sense.

What is claimed:

1. A sighting scope adapted for mounting into a sight plane of a projectile type weapon and comprising:

a housing of tubular configuration; and a visible light gathering fluorescent fiber within said housing and having a distal end at which gathered light is focused, said distal end being surrounded by a radio active substance glowable in the dark.

* * * * *